US009966692B2

(12) United States Patent
Yamachika et al.

(10) Patent No.: US 9,966,692 B2
(45) Date of Patent: May 8, 2018

(54) WATER-RESISTANT ELECTRONIC COMPONENT

(71) Applicants: HOSIDEN CORPORATION, Yao-shi, Osaka (JP); Nintendo Co., Ltd., Kyoto-shi, Kyoto (JP)

(72) Inventors: Naoki Yamachika, Yao (JP); Hideaki Taketsu, Yao (JP); Kumpei Fujita, Kyoto (JP); Hiroki Ikuta, Kyoto (JP); Shinji Hirose, Kyoto (JP); Kenichi Ikeda, Kyoto (JP); Hideki Arita, Kyoto (JP); Yusuke Murakami, Kyoto (JP); Hiroaki Okada, Kyoto (JP)

(73) Assignees: Hosiden Corporation, Yao-Shi, Osaka (JP); Nintendo Co., Ltd., Kyoto-shi, Kyoto (JP)

( * ) Notice: Subject to any disclaimer, the term of this patent is extended or adjusted under 35 U.S.C. 154(b) by 0 days. days.

(21) Appl. No.: 15/469,123

(22) Filed: Mar. 24, 2017

(65) Prior Publication Data

US 2017/0294736 A1 Oct. 12, 2017

(30) Foreign Application Priority Data

Apr. 11, 2016 (JP) ..... 2016-078781

(51) Int. Cl.
*H01R 4/60* (2006.01)
*H01R 13/52* (2006.01)
*H01R 12/58* (2011.01)

(52) U.S. Cl.
CPC ..... *H01R 13/5202* (2013.01); *H01R 12/58* (2013.01); *H01R 13/5213* (2013.01); *H01R 13/5227* (2013.01)

(58) Field of Classification Search
CPC .. H01R 24/58; H01R 2201/12; H01R 13/523; H01R 13/005

(Continued)

(56) References Cited

U.S. PATENT DOCUMENTS 6,431,919 B1 * 8/2002 Wang ..... H01R 13/6456 439/490
7,534,146 B2 * 5/2009 Chien ..... H01R 24/58 439/668

(Continued)

FOREIGN PATENT DOCUMENTS

EP 3103528 A2 12/2016
EP 3103529 A2 12/2016

(Continued)

OTHER PUBLICATIONS

Extended European Search Report for Application No. EP 17020104.0, published by the EPO, dated Jul. 17, 2017, including corresponding Communication, Annex, Information on Strategy, and 6-page EPO Form 1703.

*Primary Examiner* — Phuong Chi T Nguyen
(74) *Attorney, Agent, or Firm* — Kilyk & Bowersox, P.L.L.C.

(57) ABSTRACT

A water-resistant electronic component including a body, a protectable part, a sealing sheet, and a cover. The body includes a water-resisting wall of loop shape. The water-resisting wall extends in a first direction. The protectable part includes at least part of a functional part of the water-resistant electronic component and is located within the water-resisting wall of the body. The sealing sheet includes a perimeter portion. The sealing sheet covers the protectable part from one side in the first direction, with the perimeter portion abutting the water-resisting wall from the one side in the first direction. The cover is fixed to the body such as to cover the sealing sheet and the water-resisting wall from the one side in the first direction.

20 Claims, 10 Drawing Sheets

(58) Field of Classification Search
USPC ..... 439/669, 668, 909, 191, 190
See application file for complete search history.

(56) References Cited

U.S. PATENT DOCUMENTS

| | | | | |
|---|---|---|---|---|
| 7,575,482 | B1 * | 8/2009 | Pepe | H01R 4/2433 439/676 |
| 8,512,082 | B1 * | 8/2013 | Ku | H01R 12/58 439/676 |
| 9,033,725 | B2 * | 5/2015 | Fransen | H01R 13/6461 439/344 |
| 9,735,523 | B2 * | 8/2017 | Taylor | H01R 24/76 |
| 2005/0142952 | A1 * | 6/2005 | Peng | H01R 13/6464 439/676 |
| 2014/0030911 | A1 * | 1/2014 | Nagata | H01R 13/5202 439/519 |
| 2016/0134049 | A1 | 5/2016 | Kataoka et al. | |

FOREIGN PATENT DOCUMENTS

| | | | |
|---|---|---|---|
| JP | 2014229489 | A | 12/2014 |
| JP | 2015011949 | A | 1/2015 |
| WO | 2015002241 | A1 | 1/2015 |
| WO | 2015028953 | A1 | 3/2015 |

* cited by examiner

WATER-RESISTANT ELECTRONIC COMPONENT

CROSS-REFERENCE TO RELATED APPLICATIONS

The present application claims priority under 35 U.S.C. § 119 of Japanese Patent Application No. 2016-078781 filed on Apr. 11, 2016, the disclosure of which is expressly incorporated by reference herein in its entirety.

BACKGROUND OF THE INVENTION

Technical Field

The invention relates to water-resistant electronic components.

Background Art

A conventional electronic component, particularly a water-resistant connector, is described in Japanese Unexamined Patent Publication No. 2015-011949. The electronic component includes a plurality of terminals, sealing parts, and a body. The terminals each include a distal portion, an intermediate portion, and a basal portion. The sealing parts are double-sided adhesive tapes respectively wound around the intermediate portions of the terminals. The body is made of an insulating resin. The body has a main part and tuboid connecting portions extending from the main part. The intermediate portions of the terminals and the sealing parts are insert-molded in the main part of the body, and the distal ends of the terminals are housed in the connection portions. Such conventional water-resistant electronic component provides a water-resistant structure in which the intermediate portions of the terminals and the sealing parts are insert-molded in the main part of the body and the sealing parts are interposed between the terminals and the main part so as to block small gaps between the terminals and the main part.

SUMMARY OF INVENTION

The water-resistant structure of the above conventional water-resistant electronic component is achieved by insert molding and therefore cannot be applied to different types of electronic components with terminals that are not insert-molded (for example, terminals inserted and retained in retaining holes in a preformed body). Such electronic components may be made water resistant by inserting the terminals and sealing parts wound therearound into the retaining holes. However, since the sealing parts are double-sided adhesive tapes, their adhesiveness would make it difficult to insert the terminals with the adhesive sealing parts into the retaining holes of the body. Thus, the above water-resistant configuration may be applicable only to a limited range of components.

Further, the manufacture of the conventional water-resistant electronic component requires winding a sealing part around each terminal. This result in extra time and effort required to provide the water-resistant structure in the electronic component.

In view of the above circumstances, the invention provides a water-resistant electronic component with a water-resistant structure that can be readily manufactured and applicable to a wide range of components and devices to be made water-resistant.

A water-resistant electronic component according to an embodiment of the invention includes a body, a protectable part, a sealing sheet, and a cover. The body includes a water-resisting wall of loop shape. The water-resisting wall extends in a first direction. The protectable part includes at least part of a functional part of the water-resistant electronic component and is located within the water-resisting wall of the body. The sealing sheet includes a perimeter portion. The sealing sheet covers the protectable part from one side in the first direction, with the perimeter portion abutting the water-resisting wall from the one side in the first direction. The cover is fixed to the body such as to cover the sealing sheet and the water-resisting wall from the one side in the first direction.

The water-resistant electronic component of this aspect provides at least the following technical features and effects. First, it is easy to manufacture the water-resistant structure of the water-resistant electronic component because the structure is comprised of the water-resisting wall and the sealing sheet. Specifically, the water-resistant structure of the water-resistant electronic component can be readily manufactured by bringing the perimeter portion of the sealing sheet into abutment with the water-resisting wall and covering the protectable part with the sealing sheet. Second, the water-resistant electronic component has a wide range of application. This is because the protectable part of the water-resistant electronic component only needs to include at least part of a functional part of the electronic component and be located within the water-resisting wall.

The body may further include at least one groove substantially surrounding the water-resisting wall. The water-resistant electronic component of this aspect has improved water resistance. This is because of decreased possibility that liquid entering the groove may enter the inside of the water-resisting wall and the sealing sheet.

The groove may have such a crosswise dimension as to allow the groove to collect liquid entering the groove by capillary action. The water-resistant electronic component of this aspect has further improved water resistance. This is because liquid entering the groove will be collected in the groove, resulting in further decreased possibility that liquid may otherwise enter the inside of the water-resisting wall and the sealing sheet.

The groove may include a first portion and a second portion spaced from each other in a longitudinal direction of the groove. The crosswise dimension of the groove may gradually decrease from the first portion to the second portion. In the water-resistant electronic component of this aspect, liquid entering an intermediate portion between the first portion and the second portion will be retained in the intermediate portion of the groove or move from the intermediate portion of the groove toward the second portion of the groove by the capillary action. For this reason, the liquid entering somewhere in the groove is unlikely to move toward the first portion of the groove.

The groove may include a first groove portion of generally rectilinear shape and a second groove portion of generally rectilinear shape. The first groove portion may include a first end and a second end opposite to each other in a longitudinal direction of the first groove portion. The second groove portion may extend from the second end of the first groove portion in a direction crossing the first groove portion. The second groove portion may include first and second ends opposite to each other in a longitudinal direction of the second groove portion. The first end of the second groove portion may communicate with the second end of the first groove portion. A relation $D1<D2<D3$ may be satisfied, where D1 may be a crosswise dimension of the first end of the first groove portion, D2 may be a crosswise dimension of the first end of the second groove portion, and D3 may be a crosswise dimension of the second end of the second groove portion.

In the water-resistant electronic component of this aspect, as the dimension D2 is smaller than the dimension D3, liquid entering a portion of the second groove portion is unlikely to move toward the first end of the second groove portion and unlikely to move beyond the first end of the second groove portion and then into the first groove portion. Also, as the dimension D1 is smaller than the dimension D2, liquid entering a portion of the first groove portion is unlikely to move toward the first end of the first groove portion.

The groove may be generally U-shaped and may further include a third groove portion of generally rectilinear shape. The third groove portion may extend from the second end of the second groove portion in a direction crossing the second groove portion. The third groove portion may include first and second ends opposite to each other in a longitudinal direction of the third groove portion. The first end of the third groove portion may communicate with the second end of the second groove portion. A relation $D1<D2<D3<D4$ may be satisfied, where D4 may be a crosswise dimension of the second end of the third groove portion.

In the water-resistant electronic component of this aspect, as the dimension D3 is smaller than the dimension D4, liquid entering a portion of the third groove portion is unlikely to move toward the first end of the third groove portion and unlikely to move beyond the first end of the third groove portion and then into the second groove portion. Also, as the dimension D2 is smaller than the dimension D3, liquid entering a portion of the second groove portion is unlikely to move toward the first end of the second groove portion and unlikely to move beyond the first end of the second groove portion and then into the first groove portion. Further, as the dimension D1 is smaller than the dimension D2, liquid entering a portion of the first groove portion is unlikely to move toward the first end of the first groove portion.

The body may further have a first water-retaining hole formed in a bottom of the groove. The water-resistant electronic component of this aspect has further improved water resistance. This is because liquid entering the groove will be collected in the first water-retaining hole, resulting in further decreased possibility that liquid may otherwise enter the inside of the water-resisting wall and the sealing sheet.

The guide may include a cover body and a side plate. The cover body may be of platelike shape covering the sealing sheet and the water-resisting wall. The side plate may extend from an end of the cover body to the other side in the first direction and may be received in the groove. The water-resistant electronic component of this aspect has further improved water resistance. This is because liquid adhering to the cover body will move along the side plate and enter the groove, resulting in further decreased possibility that liquid may otherwise enter the inside of the water-resisting wall and the sealing sheet.

The side plate may be received not only in the groove but also in the first water-retaining hole. The water-resistant electronic component of this aspect has further improved water resistance. This is because liquid adhering to the cover body will move along the side plate and enter the first water-retaining hole, resulting in further decreased possibility that liquid may otherwise enter the inside of the water-resisting wall and the sealing sheet.

The body further may have at least one second water-retaining hole extending outside and along the water-resisting wall. The water-resistant electronic component of this aspect has improved water resistance. This is because liquid can enter the second water-retaining hole, resulting in further decreased possibility that liquid may otherwise enter the inside of the water-resisting wall and the sealing sheet.

The body may further include a pair of partitions extending one on each side of the second water-retaining hole from the water-resisting wall. The water-resistant electronic component of this aspect has further improved water resistance. This is because the second water-retaining hole is surrounded by the water-resisting wall and the pair of partitions, reducing the possibility that liquid entering the second water-retaining hole may leak out.

The cover may further include a lug. The lug may extend from an end of the cover body to the other side in the first direction and may be received in the second water-retaining hole. The water-resistant electronic component of this aspect has further improved water resistance. This is because liquid adhering to the cover body will move along the lug and enter the second water-retaining portion, resulting in further decreased possibility that liquid may otherwise enter the inside of the water-resisting wall and the sealing sheet.

The lug of the cover may be engaged in the second water-retaining hole. In the water-resistant electronic component of this aspect, the cover can be readily fixed to the body.

The water-resistant electronic component may further include a circuit board. The second water-retaining hole may pass through the body in the first direction. The circuit board may be disposed such as to cover the second water-retaining hole at least partly from the other side in the first direction. The lug of the cover may be grounded to the circuit board.

In the water-resistant electronic component of this aspect, the cover can be readily grounded, without degrading the water-resistance of the electronic component. The lug of the cover can be grounded to the circuit board by inserting the lug of the cover into the second water-retaining hole of the body. As the circuit board covers the second water-retaining hole at least partly from the other side in the first direction, liquid entering the second water-retaining hole will be collected therein. This results in further decreased possibility that liquid may otherwise enter the inside of the water-resisting wall and the sealing sheet.

The sealing sheet may be a double-sided adhesive tape bonded to the water-resisting wall and the cover. In the water-resistant electronic component of this aspect, the sealing sheet is bonded to the water-resisting wall and the cover. This configuration results in further decreased possibility that liquid may otherwise enter the inside of the water-resisting wall. Moreover, as the sealing sheet bonds the cover and the water-resisting wall together, the cover is fixed to the cover more firmly.

BRIEF DESCRIPTION OF DRAWINGS

The present invention can be even more fully understood with the reference to the accompanying drawings which are intended to illustrate, not limit, the present invention.

DESCRIPTION OF EMBODIMENTS

Figure 1A:
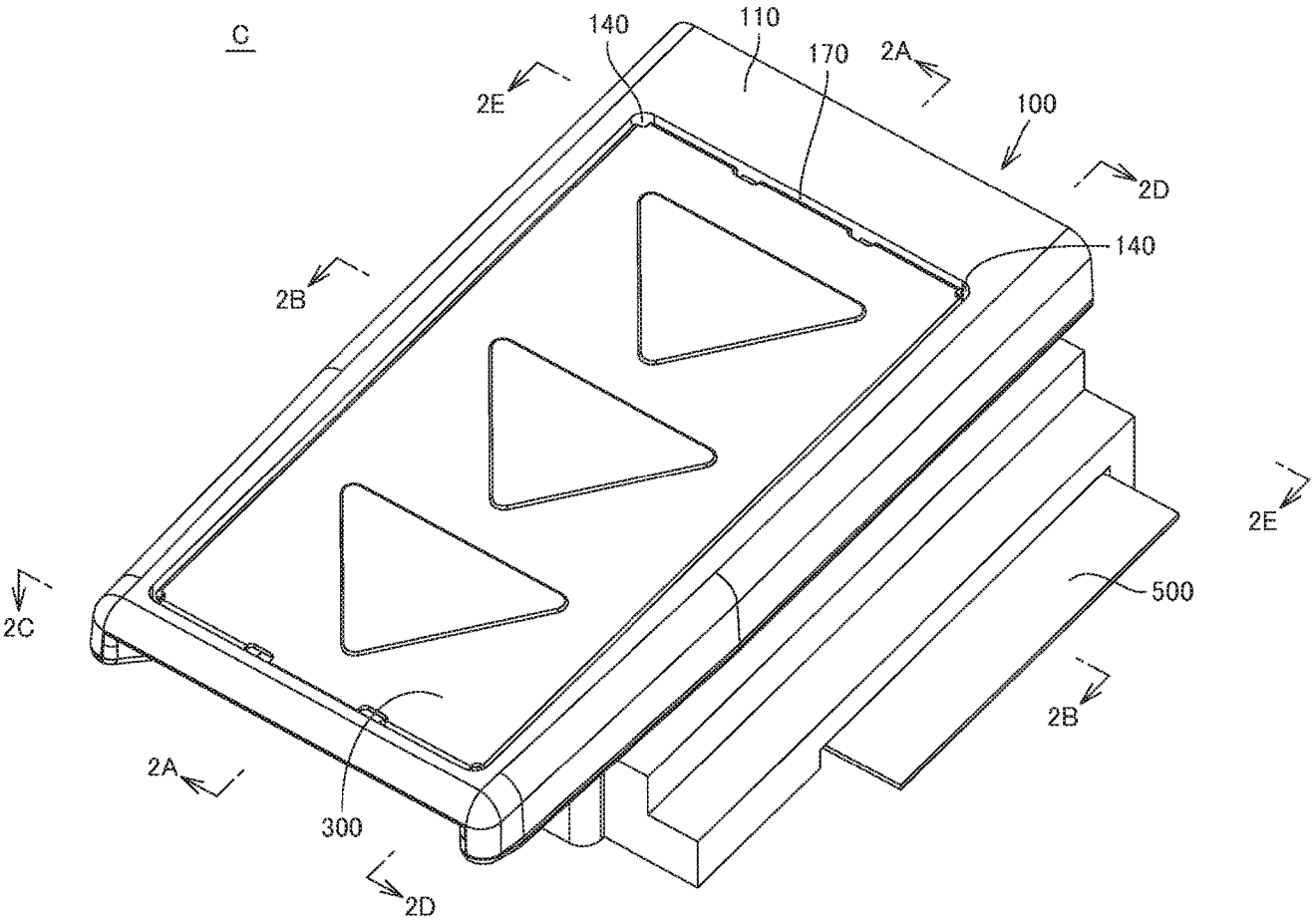
FIG. 1A is a front, top, right side perspective view of a water-resistant electronic component according to an aspect of the invention.
Figure 1B:
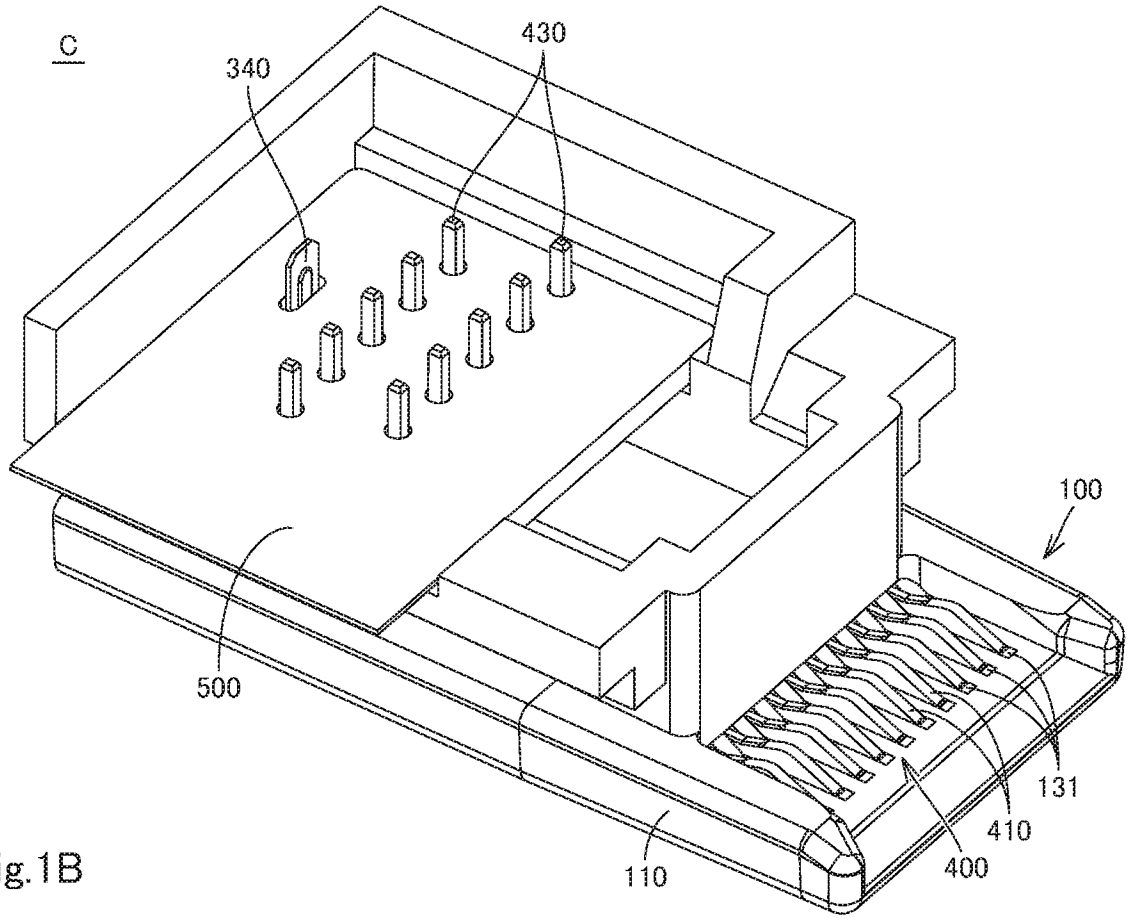
FIG. 1B is a front, bottom, right side perspective view of the electronic component.

A water-resistant electronic component C according to an embodiment of the invention will be described below with reference to FIG. 1A to FIG. 4B. The water-resistant electronic component C (also referred to simply as an "electronic component C") includes a body 100, a protectable part S, and a water-resistant structure. As indicated in FIGS. 2A, 2B, 2D, 2E, 4A, and 4B, the Z-Z' direction is the height direction of a water-resisting wall 120 of the body 100 of the electronic component C and corresponds to the first direction referred to hereafter. In the Z-Z' direction, the Z direction corresponds to one side in the first direction, and the Z' direction corresponds to the other side in the first direction. As indicated in FIGS. 2A, 2C, 2D, and 3 to 4B, the Y-Y' direction illustrated is orthogonal to the Z-Z' direction and may also referred to as a second direction. As indicated in FIGS. 2B, 2C, and 2E to 4B, the X-X' direction is orthogonal to the Z-Z' and Y-Y' directions and may also referred to as a third direction.

The body 100 is made of an insulating resin. The body 100 includes a main body 110 provided with the water-resisting wall 120 mentioned above. The water-resistant structure of the electronic component C at least includes the water-resisting wall 120 of the body 100 and a sealing sheet 200. The water-resisting wall 120 is a wall having a cross-section of loop shape (e.g. circular loop shape and rectangular loop shape) and extends in the Z-Z' direction. In other words, the water-resisting wall 120 is a tube extending in the Z-Z' direction. The water-resisting wall of the invention may be a continuous loop-shaped wall or may consist of a plurality of walls generally forming a loop-shape with or without one or more discontinuous areas.

The protectable part S is a part to be protected from water and other liquid intruding from outside of the electronic component C. The protectable part S includes at least part of a functional part of the electronic component C and is located within the water-resisting wall 120. The functional part may be any part of the electronic component C that performs a certain function. In an aspect of the invention, the electronic component C is a connector, and the functional part is a plurality of terminals 400. The terminals 400 function as connecting parts of the electronic component C (connector) to be electrically connected to respective terminals (hereinafter referred to as "mating terminals") of a mating connector (not shown). In another aspect of the invention, the functional part of the electronic component C may be a sensor, an active component, a passive component, and/or a circuit board. The sensor may be a touch panel, a touch switch, or a human sensor. The active component may be a semi-conductor device or an electric motor. The passive component may be a resistor, a capacitor, a coil, a transformer, a relay, a piezoelectric element, and an oscillator. As such, the electronic component C is not limited to a connector.

Figure 2A:
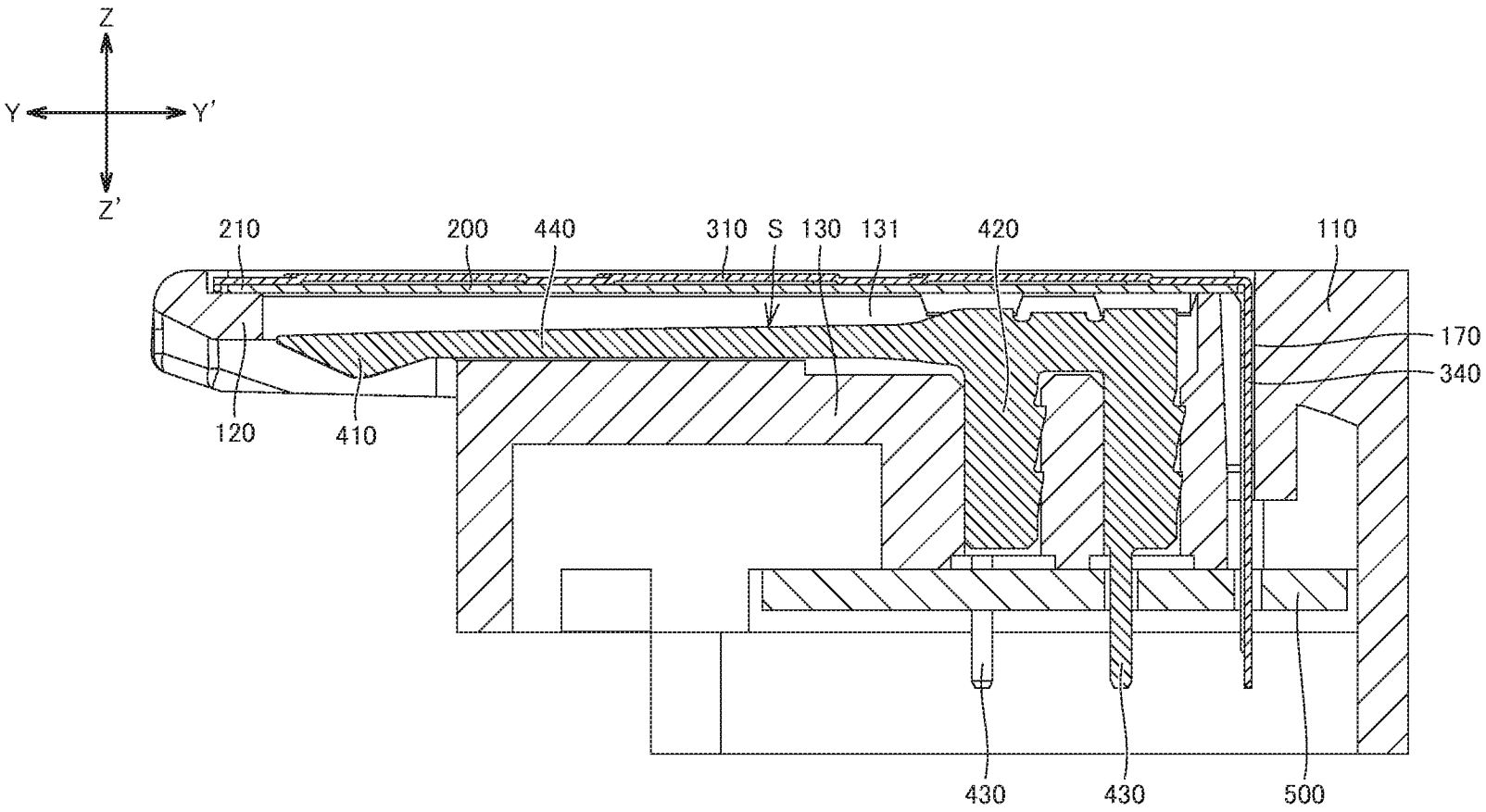
FIG. 2A is a cross-sectional view of the electronic component, taken along line 2A-2A in FIG. 1A.
Figure 2B:
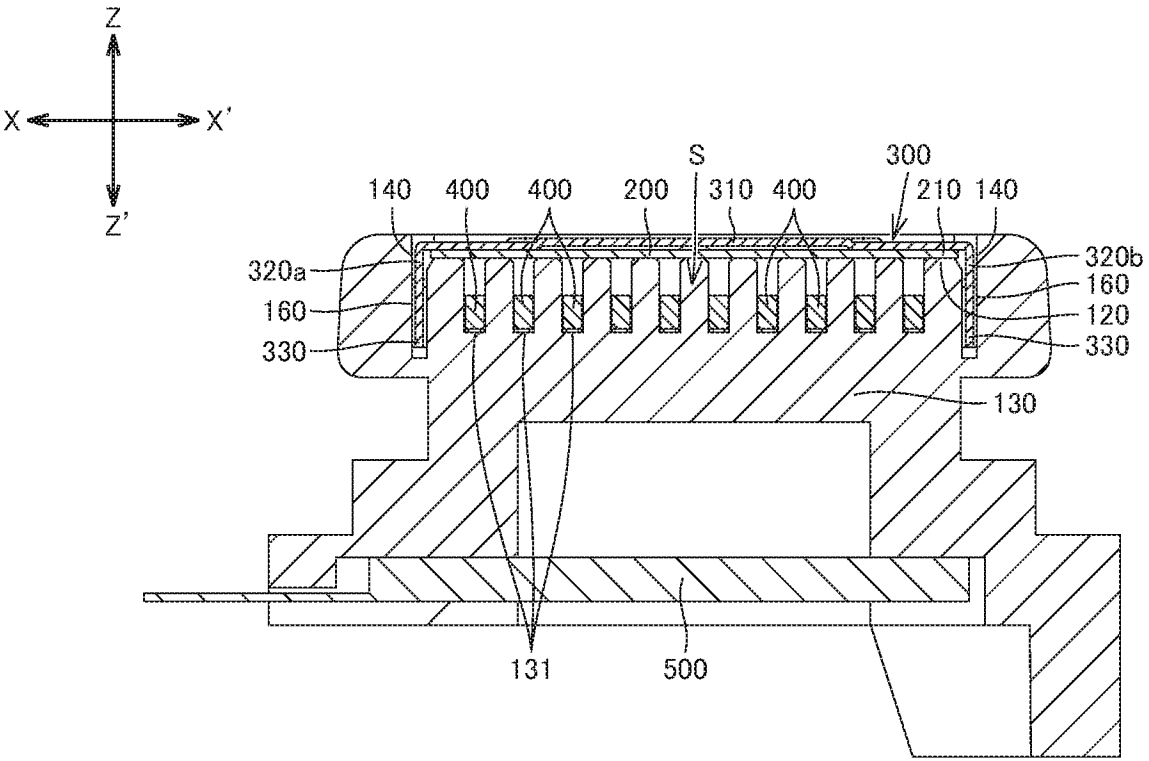
FIG. 2B is a cross-sectional view of the electronic component, taken along line 2B-2B in FIG. 1A.
Figure 2C:
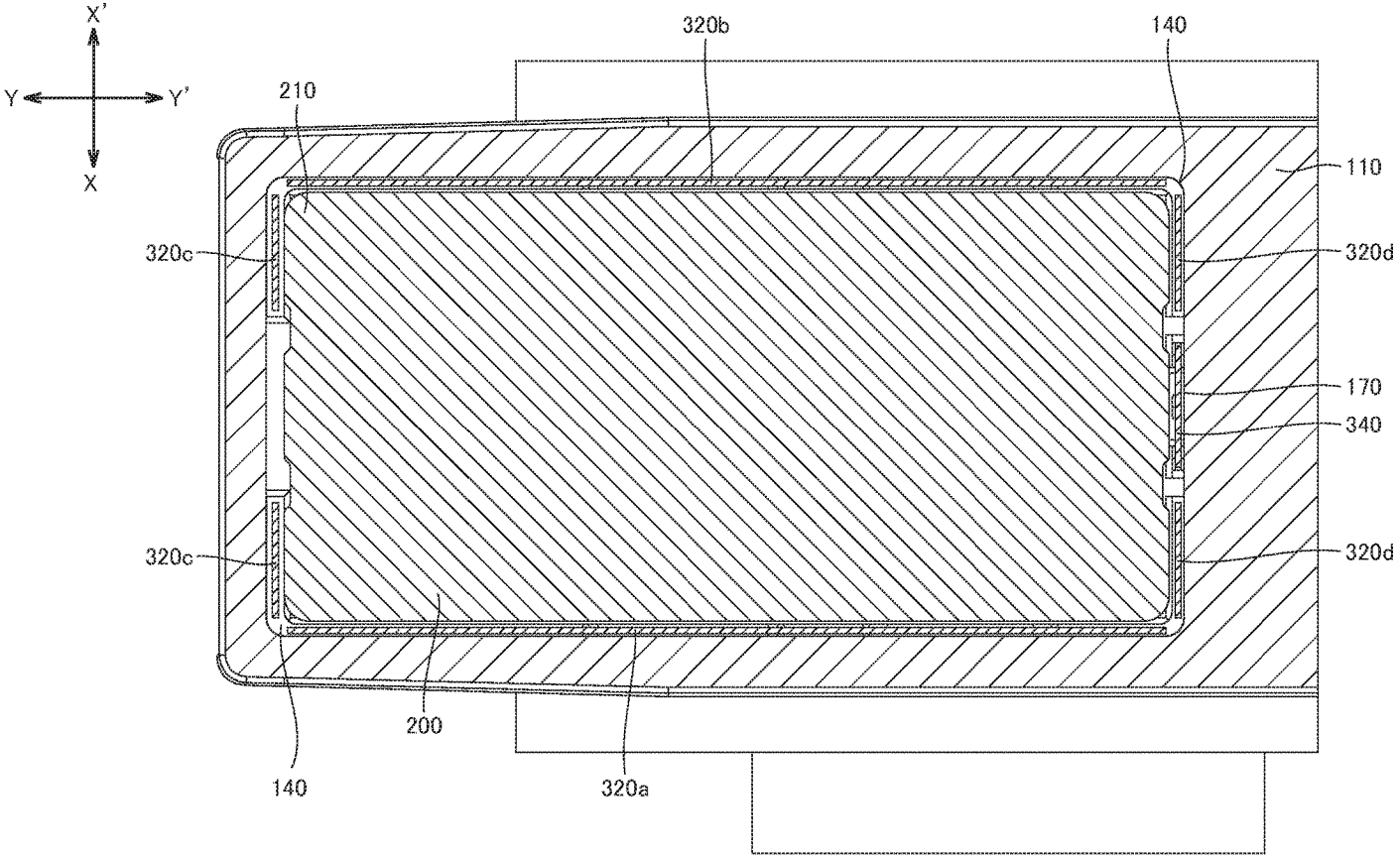
FIG. 2C is a cross-sectional view of the electronic component, taken along line 2C-2C in FIG. 1A.

The protectable part S may further include a retainer portion 130. The retainer portion 130 is located within the water-resisting wall 120 of the main body 110 and holds at least a portion of the functional part of the electronic component C. If the functional part of the electronic component C is the terminals 400, the retainer portion 130 may be a block portion of the main body 110. The block portion is provided within the water-resisting wall 120 and holds at least a portion of each of the terminals 400 that are arrayed in spaced relation along the X-X' direction. More particularly, the retainer portion 130 may have a plurality of retainer holes 131 each for receiving at least a portion of each terminal 400 as shown in FIGS. 2A to 2C, or alternatively the terminals 400 may be insert-molded in the retainer portion 130. In the former case, the retainer holes 131 are arrayed in spaced relation along the X-X' direction, inside the block that is located within the water-resisting wall 120 of the main body 110. Each retainer hole 131 has a cross-section in the Z-Z' and Y-Y' directions conforming to the cross-section in the Z-Z' and Y-Y' directions of said at least a portion of each terminal 400. The retainer holes 131 may be partly or entirely open in the Z direction or in the Z' direction. If the functional part of the electronic component C is a sensor, an active component, a passive component and/or a circuit board, the retainer portion 130 is a portion of the main body 110 with a holding recess or hole to receive and hold the functional part, and this portion is located within the water-resisting wall 120.

The terminals 400 are metal plates extending at least in the Y-Y' direction. The terminals 400 each includes a contact portion 410, a retainable portion 420, and a tail 430. The retainable portions 420 are received and retained in the respective retainer holes 131 of the retainer portion 130 or insert-molded in the retainer portion 130. The contact portions 410 are exposed or protrude out of the retainer portion 130 of the body 100, so that the contacts 400 are contactable at the contact portions 410 with respective mating terminals of a mating connector. The tails 430 may be exposed or protrude out of the retainer portion 130 in the Z' or Y' direction.

Figure 4A:
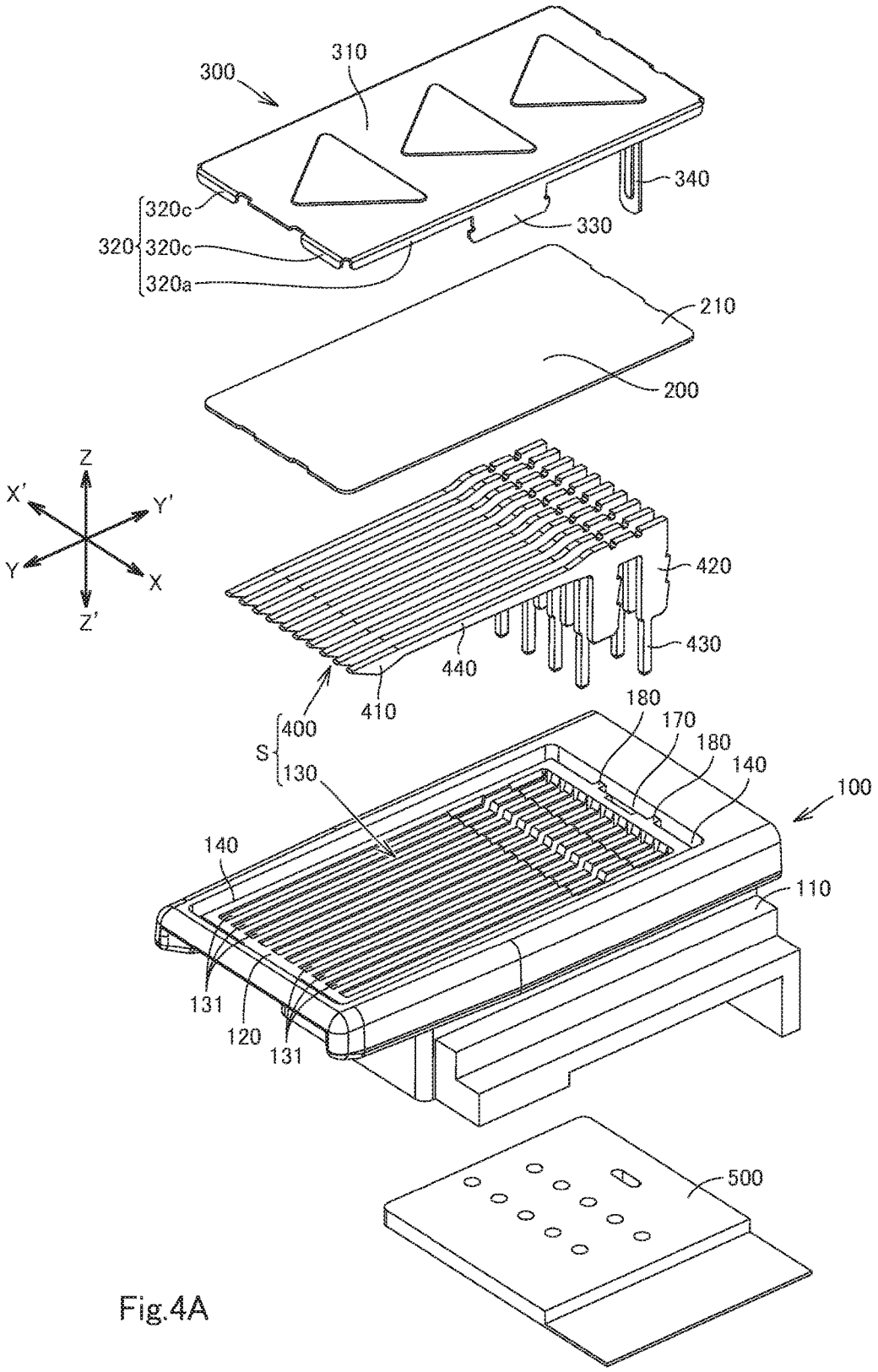
FIG. 4A is a front, top, right side perspective exploded view of the electronic component.
Figure 4B:
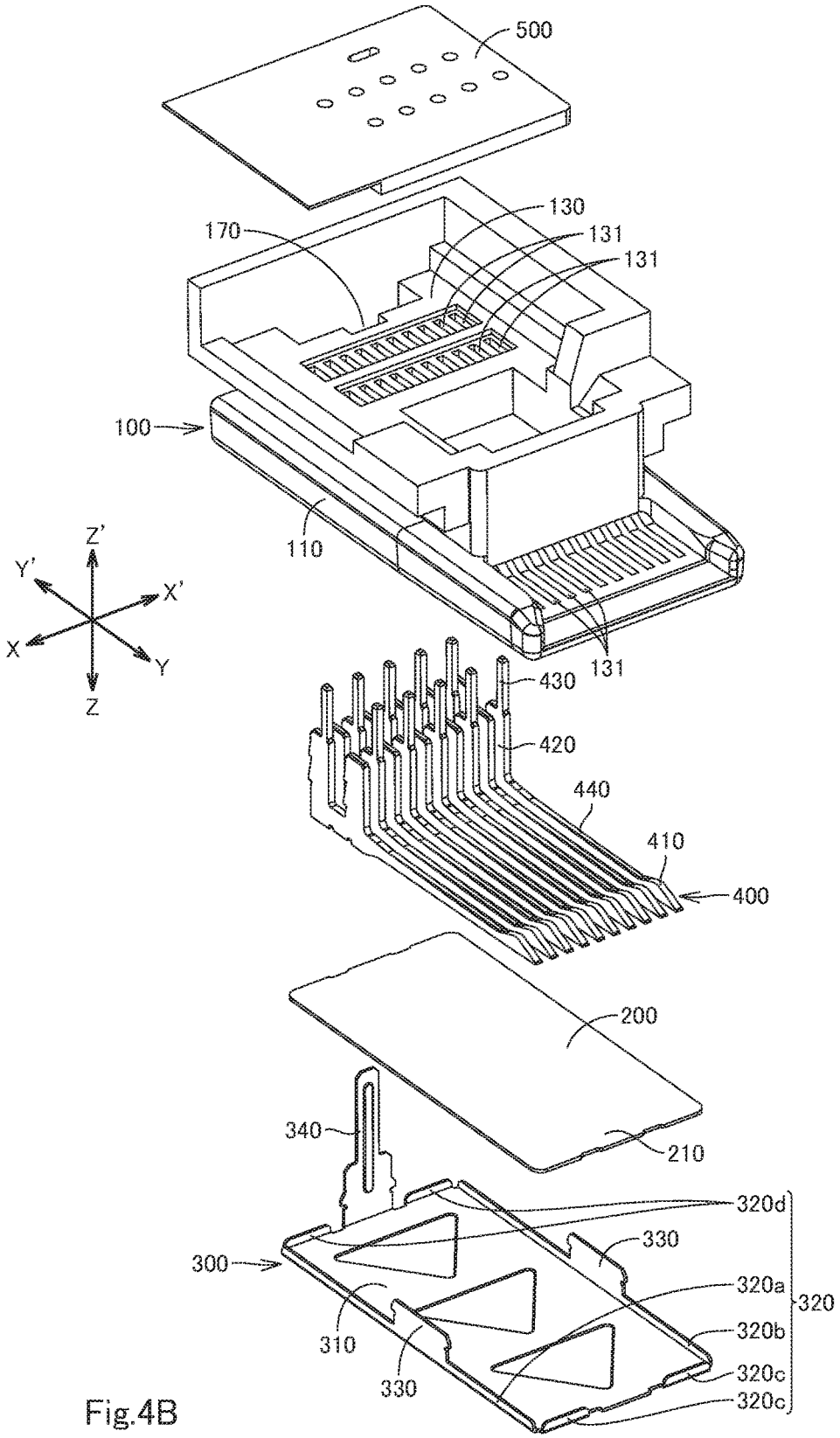
FIG. 4B is a front, bottom, right side perspective exploded view of the electronic component.

The electronic component shown in FIGS. 2A, 4A, and 4B include two types of terminals 400. The terminals of the first type have tails 430 extending from the Y-direction ends of the retainable portions 420, while the terminals of the second type have tails 430 extending from the Y'-direction ends of the retainable portions 420. With the minor difference, the two types of terminals will be simply referred to as terminals 400 collectively for convenience of description. The terminals 400 are generally L-shaped and each further include an arm 440. The retainable portions 420 are generally of inverted U-shape opening in the Z' direction. The retainable portions 420 are received and retained in the respective retainer holes 131 of the retainer portion 130. The arms 440 extend in the Y direction from the respective retainable portions 420 and received in the respective retainer holes 131. The arms 440 are elastically deformable in the Z direction upon application of loads onto the contact portions 410 from the Z'-direction side. The contact portions 410 are continuous with the respective arms 440 and protrude in the Z' direction out of the respective retainer holes 131. When contacted by mating terminals of a mating connector, the contact portions 410 are pressed by the mating terminals to the Z-direction side. In other words, loads are applied onto the contact portions 410 from the Z'-direction side. The tails 430 extends in the Z' direction from the Y-direction ends, or the Y'-direction ends, of the retainable portions 420 to be located outside the respective retainer holes 131. The retainer holes 131 of the retainer portion 130 are entirely open in the Z direction and also partly open in the Z' direction to expose the contact portions 410 and the tails 430.

The sealing sheet 200 is made of material that has at least a waterproofing property. Particularly, the sealing sheet 200 may be a double-sided adhesive tape, a rubber sheet, or a plastic sheet of polyvinyl chloride or the like material. Preferably, the sealing sheet 200 of outer size larger at least than the inner size of the water-resisting wall 120 of the body 100. The sealing sheet 200 may be of outer size substantially same as, smaller than, or larger than the outer size of the water-resisting wall 120. The sealing sheet 200 includes a perimeter portion 210. The sealing sheet 200 covers the protectable part S from the Z-direction side, with the perimeter portion 210 in abutment with the water-resisting wall 120 from the Z-direction side. The sealing sheet may be formed from an electrically insulating material.

If the sealing sheet 200 is a double-sided adhesive tape, only the perimeter portion 210 thereof may be bonded to the Z-direction face of the water-resisting wall 120, or alternatively the sealing sheet 200 may be bonded to the water-resisting wall 120 and also to the retainer portion 130 of the protectable part S. If the sealing sheet 200 is not a double-sided adhesive tape, only the perimeter portion 210 thereof may be in contact with the Z-direction face of the water-resisting wall 120, or alternatively only the perimeter portion 210 may be bonded to the Z-direction face of the water-resisting wall 120 with adhesive, or alternatively the sealing sheet 200 may be bonded to the water-resisting wall 120 and also to the retainer portion 130 of the protectable part S with adhesive.

The electronic component C further includes a cover 300 formed of a plate of metal, plastic, or other material. The cover 300 is fixed to the body 100 such as to cover the sealing sheet 200 and the water-resisting wall 120 from the Z-direction side. The cover 300 preferably includes at least a cover body 310. The cover body 310 is a plate covering the sealing sheet 200 and the water-resisting wall 120 from the Z-direction side. The cover body 310 is of outer size larger at least than the outer size of the sealing sheet 200. The cover body 310 may be of outer size larger than the outer sizes of the sealing sheet 200 and the water-resisting wall 120. The cover body 310 and the water-resisting wall 120 of the body 100 may directly hold therebetween the perimeter portion 210 of the sealing sheet 200. In this case, the cover body 310 is bonded to the sealing sheet 200 if the sealing sheet 200 is a double-sided adhesive tape. Alternatively, if the sealing sheet 200 is not a double-sided adhesive tape, the cover body 310 may be in contact with the sealing sheet 200 or may be bonded to the sealing sheet 200 with adhesive. Alternatively, another member may be disposed between the cover body 310 and the sealing sheet 200.

The outer face (face on the Z-direction side) of the cover body 310 may be exposed to the external environment. In this case, the outer face may be touched by a human hand and subjected to sweat and other body fluid coming out through the hand, and/or to tap water or other fluid adhering to the hand. The outer face of the cover body 310 may also be subjected to some fluid for other reasons. Such various kinds of fluid may adhere to the outer face of the cover body 310.

The body 100 may further include at least one groove 140 substantially surrounding the water-resisting wall 120. The at least one groove 140 may be a loop-shaped groove extending along and surrounding the water-resisting wall 120. If a plurality of grooves 140 is provided, the grooves 140 may be arranged in spaced relation such as to extend along and surround the water-resisting wall 120. In the embodiment as shown in FIGS. 2B to 2D, 3, and 4A, there are two grooves 140, each generally in U-shape when viewed from the Z-direction side (i.e. in plan view), extending along and surrounding the water-resisting wall 120. The generally U-shaped grooves 140 of the invention may particularly be generally square U-shaped grooves, generally C-shaped grooves, or generally arc-shaped grooves. The two grooves 140 are disposed symmetrically on opposite sides of the water-resisting wall 120. There are gaps between the ends of the two grooves 140.

Each of the at least one groove 140 may be a bottomed groove opening in the Z direction (see FIGS. 2B to 2D, 3, and 4A) or a slit-groove passing through the body 100 in the Z-Z' direction.

Liquid adhering to the outer face of the cover body 310 may move along the cover body 310 and enter each groove 140. Each groove 140 may be configured to collect liquid entering the groove. For example, each groove 140 may have a crosswise dimension as to allow the groove 140 to collect liquid entering the groove 140 by capillary action. The crosswise dimension of the groove 140 may preferably be 0.1 mm to 0.5 mm but is not limited to the range. Also, the groove 140 may have any one of the following configurations A to C.

Configuration A: Each groove 140 may include a first portion and a second portion. The first and second portions may be any portions of the groove 140 and separated from each other in the longitudinal direction of the groove 140. For example, the first and second portions may be opposite longitudinal end portions of the groove 140 or intermediate portions located between the opposite longitudinal ends of the groove 140. The crosswise dimension of the groove 140 may gradually decrease from the first portion to the second portion. It should be appreciated that the first portion of the groove 140 may correspond, for example, to a second end of a first groove portion 141, a second end of a second groove portion 142, or a second end of a third groove portion 143 (to be described). The second portion of the groove 140 may correspond, for example, to a first end of the first groove portion 141, a first end of the second groove portion 142, or a first end of the third groove portion 143 (to be described).

Configuration B: Each groove 140 may be generally V-shaped or generally L-shaped when viewed from the Z-direction side (in plain view). In this case, each groove 140 has a first groove portion 141 and a second groove portion 142. The first groove portion 141 is of generally rectilinear shape and has first and second ends opposite to each other in the longitudinal direction of the first groove portion 141. The second groove portion 142 is of generally rectilinear shape and has first and second ends opposite to each other in the longitudinal direction of the second groove portion 142. The second groove portion 142 extends from the second end of the first groove portion 141 in a direction crossing the first groove portion 141. The first end of the second groove portion 142 communicates with the second end of the first groove portion 141. A relation $D1<D2<D3$ is satisfied, where D1 is the crosswise dimension of the first end of the first groove portion 141, D2 is the crosswise dimension of the first end of the second groove portion 142, and D3 is the crosswise dimension of the second end of the second groove portion 142.

Configuration C: When each groove 140 is generally U-shaped in plain view, each groove 140 may include the first and second groove portions 141, 142 configured as described above and further a third groove portion 143. The third groove portion 143 is of generally rectilinear shape has a first end and a second end opposite to the first end in the longitudinal direction of the third groove portion 143. The third groove portion 143 extends from the second end of the second groove portion 142 in a direction crossing the second groove portion 142. The first end of the third groove portion 143 communicates with the second end of the second groove portion 142. A relation D1<D2<D3<D4 is satisfied. D4 is the crosswise dimension of the second end of the third groove portion 143.

In each groove 140, the crosswise dimension of the first groove portion 141 may gradually increase from the first end to the second end of the first groove portion 141. The crosswise dimension of the second groove portion 142 may gradually increase from the first end to the second end of the second groove portion 142. The crosswise dimension of the third groove portion 143 may gradually increase from the first end to the second end of the third groove portion 143. Each groove 140 may have a maximum crosswise dimension in the range of 0.3 mm to 0.4 mm and a minimum crosswise dimension in the range of 0.15 mm to 0.25 mm. The crosswise and longitudinal directions of each groove 140 may preferably be orthogonal to the Z-Z' direction.

If the electronic component C has at least one groove 140 with configuration A) described above, higher water-resistance is provided in a region within the water-resisting wall 120 and near the second portion of the groove 140 (hereinafter referred to as a first high water-resistant region). If the electronic component C has at least one groove 140 with configuration B) or C), higher water-resistance is provided in a region within the water-resisting wall 120 and near the first groove portion 141 of the groove 140 (hereinafter referred to as a second high water-resistant region). Thus, a vital portion of the protectable part S, i.e. a vital portion of the functional part that requires high water-resistance (hereinafter referred to as a "vital portion"), should preferably be disposed in the first or second high water-resistant region. If the functional part is the terminals 400, the vital portion may correspond to the contact portions 410 of the terminals, for example.

Figure 2D:
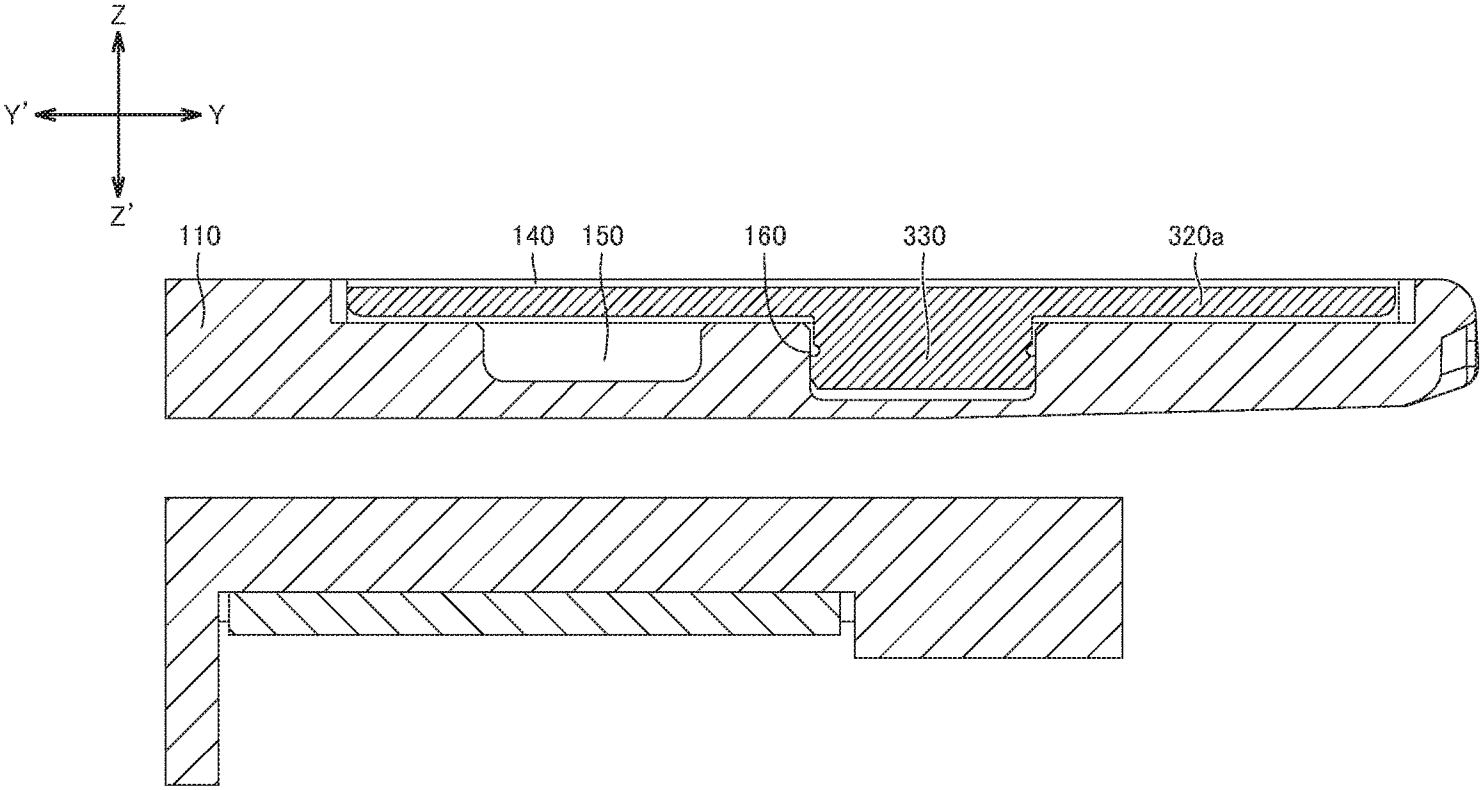
FIG. 2D is a cross-sectional view of the electronic component, taken along line 2D-2D in FIG. 1A.
Figure 3:
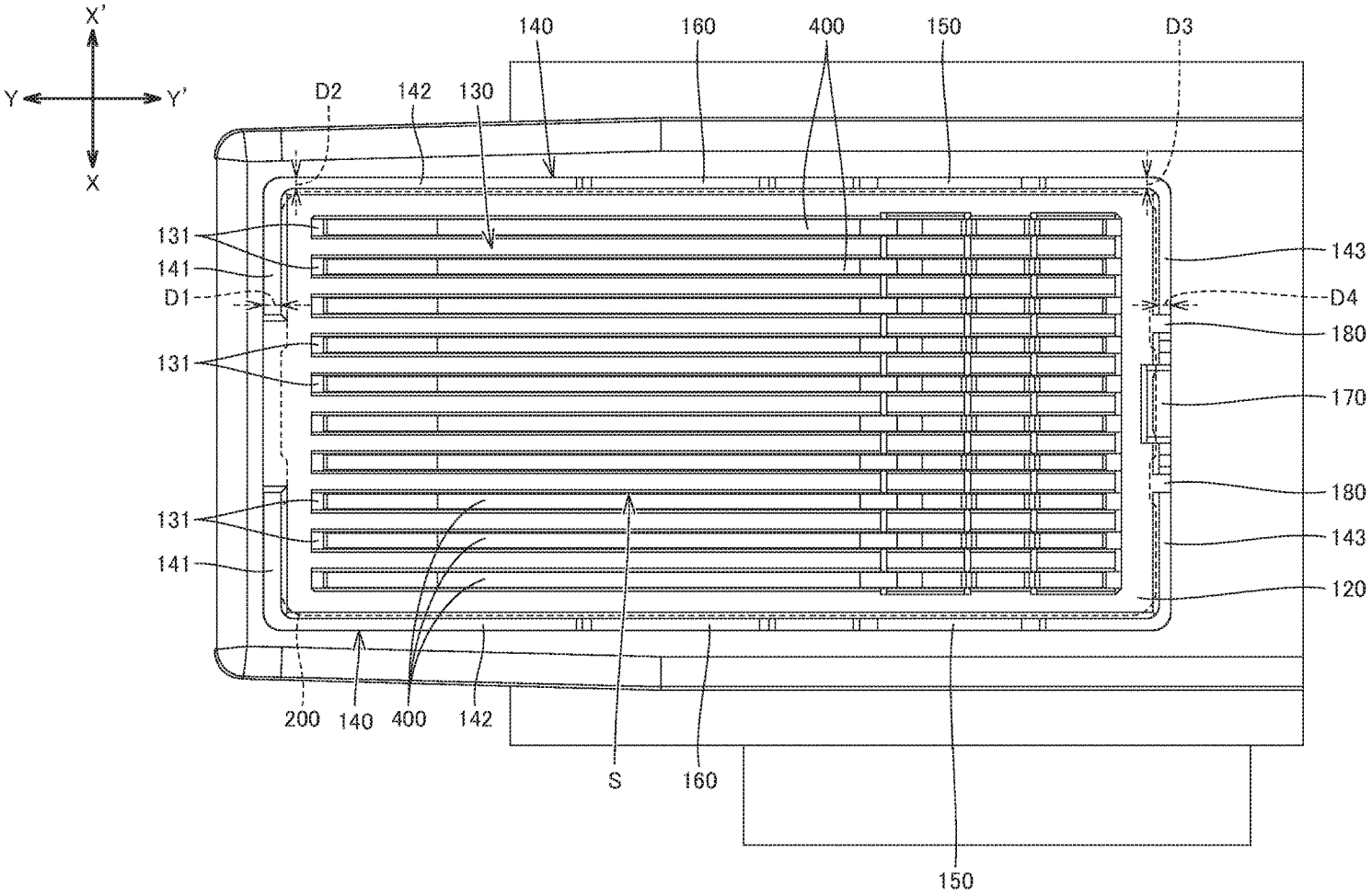
FIG. 3 is a plan view of the electronic component with a cover removed, and a sealing sheet being illustrated in broken lines.

If the body 100 includes the at least one groove 140, the body 100 may further include at least one first water-retaining hole 150 and/or at least one engaging hole 160. The first water-retaining hole 150 is a bottomed hole in the bottom of and in communication with the associated groove 140. The crosswise dimension of the first water-retaining hole 150 may be the same as, smaller than, or larger than, the crosswise dimension of the associated groove 140. Liquid entering a groove 140 enters the first water-retaining hole 150 through the groove 140 and is collected in the first water-retaining hole 150. The liquid collected in the groove 140 and/or the first water-retaining hole 150 will be discharged therefrom by evaporation. The engaging hole 160 is also provided in the bottom of and in communication with the associated groove 140. In the embodiment of FIGS. 2D and 3, the bottom of the second groove portion 142 of each of the two grooves 140 is provided with a first water-retaining hole 150 and an engaging hole 160 in spaced relation in the Y-Y' direction. In this embodiment, each first water-retaining hole 150 is disposed near the second end of the associated second groove portion 142.

When the body 100 includes the at least one groove 140, the cover 300 may further include at least one side plate 320. Each side plate 320 is a plate extending in the Z' direction from an end of the cover body 310. The at least one side plate 320 may be received (1) in the or an associated groove 140, or (2) may be received in the or an associated groove 140 and also in the or an associated first water-retaining hole 150. In case (1) above, each side plate 320 has a Z-Z' direction dimension smaller than that of the associated groove 140. Such side plate 320 serves to guide, into the groove 140, liquid adhering to the outer face of the cover body 310. In case (2) above, each side plate 320 has a Z-Z' direction dimension larger than that of the associated groove 140, and smaller than those of the associated groove 140 and the associated first water-retaining hole 150. Such side plate 320 serves to guide, into the groove 140 and the first water-retaining hole 150, liquid adhering to the outer face of the cover body 310.

The at least one side plate 320 may be engaged in the (e.g. may fit in) or an associated groove 140. Alternatively, the cover 300 may further include at least one engaging plate 330 extending in the Z' direction from the side plate 320. Each engaging plate 330 is engaged in an associated engaging hole 160 of the body 100. In the embodiment of FIGS. 4A and 4B, the at least one side plate 320 is provided as a plurality of side plates 320*a* to 320*d*. The side plate 320*a* extends in the Z' direction from the X-direction end of the cover body 310. The side plate 320*b* extends in the Z' direction from the X'-direction end of the cover body 310. Two side plates 320*c* are provided, in spaced relation from each other in the X-X' direction, extending in the Z' direction from the Y-direction end of the cover body 310. Two side plates 320*d* are provided, in spaced relation from each other in the X-X' direction, extending in the Z' direction from the Y'-direction end of the cover body 310. In this embodiment, the at least one engaging plate 330 is provided as a plurality of engaging plates 330, extending in the Z' direction from the side plates 320*a* and 320*b*.

When the body 100 includes the at least one groove 140, the body 100 may further include at least one drain outlet (not shown). Each drain outlet may preferably communicate with an associated groove 140 and open to the outside of the body 100. In this case, liquid entering each groove 140 will be discharged through the drain outlet to the outside of the body 100.

Figure 2E:
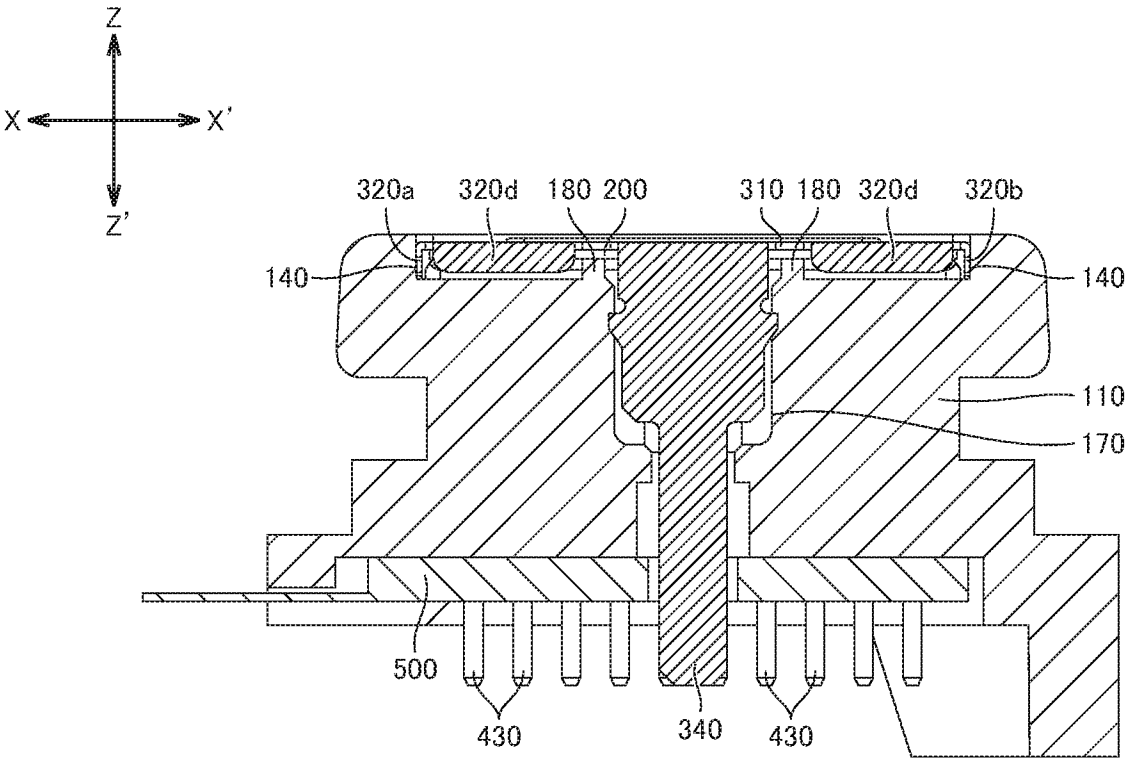
FIG. 2E is a cross-sectional view of the electronic component, taken along line 2E-2E in FIG. 1A.

The body 100 may further include at least one second water-retaining hole 170 extending outside and along the water-resisting wall 120. Each second water-retaining hole 170 may be a bottomed hole extending in the Z-Z' direction and opening in the Z direction, or alternatively a hole extending in the Z-Z' direction and passing through the body 100 in the Z-Z' direction. In the embodiment of FIGS. 2E and 3, the second water-retaining hole 170 is a through-hole located between the ends of the two grooves 140 of the body 100. The second water-retaining hole 170 includes a first portion on the Z-direction side, a second portion on the Z'-direction side, and a third portion between the first portion and the second portion. The third portion has an X-X' direction dimension smaller than that of each of the first and second portions. In other words, the third portion is narrower than each of the first and second portions. Liquid adhering to the outer face of the cover body 310 may move along the cover body 310 and enter the second water-retaining hole 170. The second water-retaining hole 170 may be configured to collect liquid entering the second water-retaining hole 170. The collected liquid will be discharged from the second water-retaining hole 170 by evaporation.

The body 100 may further include a pair of partitions 180. The partitions 180 are typically platelike walls extending from the water-resisting wall 120 to be located one on each side of the second water-retaining hole 170. In the embodiment of FIGS. 2E and 3, the pair of partitions 180 extend in the Y' direction from the water-resisting wall 120. One of the partitions 180 is located between the second water-retaining hole 170 and the proximate end of one of the grooves 140, and the other partition 180 is located between the second water-retaining hole 170 and the proximate end of the other groove 140. In other words, the second water-retaining hole 170 is surrounded by the pair of partitions 180 and a portion between the partitions 180 of the water-resisting wall 120.

When the body 100 includes the at least one second water-retaining hole 170, the cover 300 may further include at least one lug 340. Each lug 340 extends in the Z' direction from an end of the cover body 310 to be received in an associated second water-retaining hole 170. Each lug 340 guides liquid adhering to the cover body 310 into the associated second water-retaining hole 170. Each lug 340 may be engaged in the associated second water-retaining hole 170. In the embodiment of FIGS. 3 to 4B, a lug 340 is provided, extending in the Z' direction from between the two side plates 320*d* at the Y'-direction end of the cover body 310. The lug 340 is received and engaged in the second water-retaining hole 170.

The electronic component C may further include a circuit board 500. The circuit board 500 may be fixed to the body 100. The circuit board 500 may be a flexible board, a rigid flexible board, or a rigid board. Preferably, the circuit board 500 may preferably have at least one of following configurations (1) and (2). (1) The circuit board 500 is disposed on the Z'-direction side relative to the retainer portion 130 of the body 100 and connected to the tails 430 of the terminals 400. In this case, the circuit board 500 may preferably includes a corresponding number of first electrodes to be connected to the tails 430, and the first electrodes may be first through-hole electrodes or first surface electrodes. (2) If the at least one groove 140 and/or the at least one second water-retaining hole 170 pass through the body 100 in the Z-Z' direction, the circuit board 500 is disposed such as to at least partly cover, from the Z' direction, the at least one groove 140 and/or the at least one second water-retaining hole 170. Further, if the circuit board 500 at least partly covers the second water-retaining hole 170, the cover 300 may be formed of a metal plate or a plastic plate with evaporated metal coating (i.e. the cover 300 is electrically conductive), and the at least one lug 340 of the cover 300 may be received in the associated second water-retaining hole 170 and grounded to the circuit board 500. In this case, the circuit board 500 may preferably include at least one second electrode to be connected to the at least one lug 340 of the cover 300. The second electrodes may be second through-hole electrodes or second surface electrodes and may preferably be grounded via the circuit board 500. In the embodiment of FIGS. 4A and 4B, the circuit board 500 includes a plurality of first through-hole electrodes and a second through-hole electrode.

The electronic component C may include a cable (not shown), in place of the circuit board 500. The cable may preferably be connected to the tails 430 of the terminals 400.

The electronic component C according to an embodiment as shown in FIGS. 1A to 4B may be fabricated in the following steps. The body 100 and the terminals 400 are prepared. The terminals 400 are inserted into and retained in the respective retainer holes 131 of the retainer portion 130 of the body 100. The retainer portion 130 of the body 100 thus holds the terminals 400 in spaced relation in the X-X' direction.

The sealing sheet 200 is also prepared. If the sealing sheet 200 is a double-sided adhesive tape, the perimeter portion 210 of the sealing sheet 200 is bonded to the face on the Z-direction side of the water-resisting wall 120 of the body 100, so that the sealing sheet 200 covers, from the Z-direction side, the protectable part S located within the water-resisting wall 120. At this point, the sealing sheet 200 may be bonded to the retainer portion 130. If the sealing sheet 200 is not a double-sided adhesive tape, the perimeter portion 210 of the sealing sheet 200 is brought into abutment with the face on the Z-direction side of the water-resisting wall 120 of the body 100, so that the sealing sheet 200 covers, from the Z-direction side, the protectable part S located within the water-resisting wall 120. At this point, the sealing sheet 200 may be bonded with an adhesive to the water-resisting wall 120 and/or the retainer portion 130.

The cover 300 is also prepared. The cover 300 is fixed to the body 100. This fixing step includes at least one of the following steps 1) to 4): 1) allowing the cover 300 to cover, from the Z-direction side, the water-resisting wall 120 and the sealing sheet 200; 2) inserting the at least one side plate 320 of the cover 300 into the at least one groove 140 of the body 100 from the Z-direction side; 3) inserting the at least one engaging plate 330 of the cover 300, from the Z-direction side, through the associated groove or grooves 140 of the body 100 and then into the associated engaging hole or holes 160 so as to engage the at least one engaging plate 330 in the engaging hole or holes 160; and/or 4) inserting the at least one lug 340 of the cover 300, from the Z-direction side, into the associated second water-retaining hole or holes 170 of the body 100 so as to engage the at least one lug 340 in the second water-retaining hole or holes 170. In the fixing step of the cover 300, the cover 300 may be bonded to the sealing sheet 200.

The circuit board 500 is also prepared. The circuit board 500 is attached to the retainer portion 130 of the body 100 from the Z'-direction side. At this point, the tails 430 of the terminals 400 are inserted into the respective first through-hole electrodes of the circuit board 500, and the lug 340 of the cover 300 is inserted into the second through-hole electrode of the circuit board 500. The tails 430 are then connected to the respective first through-hole electrodes of the circuit board 500 by soldering or other means, and the lug 340 is connected to the second through-hole electrode of the circuit board 500 by soldering or other means. The electronic component C is thus manufactured as shown in FIGS. 1A to 4B.

The water-resistant electronic component C of the aspects described above provides at least the following technical features and effects. First, the electronic component C can be readily manufactured because its water-resistant structure is comprised at least of the water-resisting wall 120 of the body 100 and the sealing sheet 200 as described above. Specifically, the water-resistant structure of the electronic component C can be manufactured simply by bringing the perimeter portion 210 of the sealing sheet 200 into abutment with, or boding it to, the water-resisting wall 120 and then covering the protectable part S with the sealing sheet 200. The same holds true for cases where the body 100 has the at least one groove 140 and/or the at least one second water-retaining hole 170, such groove or grooves 140 and/or the second water-retaining hole or holes 170 can be formed together during the molding of the body 100, without increase in manufacturing steps of the water-resistant structure of the electronic component C. This also applies to cases where the body 100 has the at least one first water-retaining hole 150 and/or the at least one engaging hole 160 in addition to the groove or grooves 140.

Second, the water-resistant structure of the water-resistant electronic component C is adaptable to a wide variety of components. Particularly, the protectable part S of the electronic component C is only required to include the functional part of the electronic component C and be located within the water-resisting wall 120 of the body 100. With minimum constraints imposed, the protectable part S can be defined to be a wide variety of components.

Third, the electronic component C has improved resistance to water for the reasons 1 to 6 below.

Reason 1: The perimeter portion 210 of the sealing sheet 200 abuts or is bonded to the water-resisting wall 120 so as to allow the sealing sheet 200 to cover the protectable part S. The cover 300 covers the water-resisting wall 120 and the sealing sheet 200. Therefore, the possibility is reduced that liquid adhering to the cover 300 may enter the inside of the sealing sheet 200 and the water-resisting wall 120.

Reason 2: In cases where the water-resisting wall 120 of the body 100 is surrounded by the at least one the groove 140, the at least one groove 140 and the at least one first water-retaining hole 150, and/or the at least one second water-retaining hole 170, liquid adhering to the cover 300 can readily move along the cover 300 and enter the groove (s) 140, the first water-retaining hole(s) 150, and/or the second water-retaining hole(s) 170. Therefore, the possibility is further reduced that liquid adhering to the cover 300 may enter the inside of the sealing sheet 200 and the water-resisting wall 120.

Reason 3: In cases where the cover 300 includes the side plate or plates 320 received in the associated groove or grooves 140 of the body 100, liquid adhering to the cover 300 can readily move along the cover 300 and its side plate or plates 320 and enter the groove(s) 140 and/or the first water-retaining hole or holes 150. Also in cases where the cover 300 includes the lug or lugs 340 received in the second water-retaining hole or holes 170 of the body 100, liquid adhering to the cover 300 can readily move along the cover 300 and its lug or lugs 340 and enter the second water-retaining hole or holes 170. In all of these cases, the possibility is further reduced that the liquid adhering to the cover 300 may enter the inside of the sealing sheet 200 and the water-resisting wall 120.

Reason 4: In cases where the groove or grooves 140, the first water-retaining hole or holes 150, and/or the second water-retaining hole or holes 170 are configured to collect liquid, liquid may enter the groove or grooves 140 but will be collected therein. Therefore, the possibility is further reduced that the liquid adhering to the cover 300 may enter the inside of the sealing sheet 200 and the water-resisting wall 120.

Reason 5: In the case where each groove 140 has any one of the above-described configurations A to C, liquid entering a portion of a groove 140 will be retained in the portion or move toward another portion of the groove 140 with a smaller crosswise dimension by the capillary action, i.e. such liquid will be retained within the groove 140. It should be noted that the vital portion of the protectable part S is disposed within the water-resisting wall 120, more particularly in the vicinity of the portion of the groove 140 with the smallest crosswise dimension. This improves water-resistance of the vital portion of the protectable part S.

Reason 6: In cases where the sealing sheet 200 is a double-sided adhesive tape, the sealing sheet 200 bonds the water-resisting wall 120 and the cover 300 together. This configuration further reduce the possibility that liquid may enter the inside of the sealing sheet 200 and the water-resisting wall 120. The same effect can be achieved also in cases where the sealing sheet 200 is not a double-sided adhesive tape but is bonded to the water-resisting wall 120 and the cover 300 with an adhesive.

Fourth, the cover 300 of the electronic component C can be readily grounded to the circuit board 500 without degrading the water-resistance of the electronic component C. Particularly, the cover 300 is grounded to the circuit board 500 by inserting each of the at least one lug 340 of the cover 300 into the associated second water-retaining hole 170 of the body 100. As the circuit board 500 covers the at least one second water-retaining hole 170 at least partly from the Z'-direction side, liquid entering the at least one second water-retaining hole 170 will be collected therein. This configuration further reduce the possibility that liquid may enter the inside of the sealing sheet 200 and the water-resisting wall 120.

The water-resistant electronic component of the invention is not limited to the embodiments described above but may be modified in any manner within the scope of the claims. Possible modifications will be specifically described below.

The body of the invention may be formed without any grooves. In this case, the body may not have any first water-retaining holes or any engaging holes. Also, the body of the invention may be formed without any second water-retaining holes.

The cover of the invention may be provided without any side plates. The cover may be provided without any engaging plates. The cover may be provided without any lugs.

It should be appreciated that the electronic component of the above embodiments and variants thereof are described above by way of examples only. The materials, shapes, dimensions, numbers, arrangements, and other configurations of the constituents of the electronic component may be modified in any manner if they can perform similar functions. The configurations of the embodiment and the variants described above may be combined in any possible manner. The first direction of the invention may be any direction in which the water-resisting wall of loop shape extends. The water-resisting wall may be a generally rectangular wall with a rectangular central opening, the central opening being covered by the sealing sheet. Alternatively, the water-resisting wall may be of any convenient shape and may be formed with a central opening leaving a perimeter portion of the wall to surround the central opening in a loop shape. The protectable parts of the electronic component may be arranged substantially within the central opening, so as to be covered by the sealing sheet. The second direction of the invention may be any direction crossing the first direction. The third direction of the invention may be any direction that crosses the first direction and the second direction and is non-coplanar with the plane including the first direction and the second direction.

The present invention can include any combination of these various features or embodiments above and/or below as set-forth in sentences and/or paragraphs. Any combination of disclosed features herein is considered part of the present invention and no limitation is intended with respect to combinable features.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

REFERENCE SIGNS LIST

C: Water-resistant electronic component
100: Body
110: Main body
120: Water-resisting wall
140: Groove
141: First groove portion
142: Second groove portion
143: Third groove portion
150: First water-retaining hole
160: Engaging hole
170: Second water-retaining hole
180: Partition
S: Protectable part
130: Retainer portion 130
131: Retainer hole
400: Terminal (functional part)
410: Contact portion
420: Retainable portion
430: Tail
440: Arm
200: Sealing sheet
210: Perimeter portion
300: Cover
310: Cover body
320 (320*a*-320*d*): Side plate
330: Engaging plate
340: Lug
500: Circuit board

What is claimed is:

1. A water-resistant electronic component comprising:
a body including a water-resisting wall of loop shape, the water-resisting wall extending in a first direction;
a protectable part including at least part of a functional part of the water-resistant electronic component, the protectable part being located within the water-resisting wall of the body;
a sealing sheet including a perimeter portion, the sealing sheet covering the protectable part from one side in the first direction, with the perimeter portion abutting the water-resisting wall from the one side in the first direction; and
a cover fixed to the body such as to cover the sealing sheet and the water-resisting wall from the one side in the first direction.

2. The water-resistant electronic component according to claim 1, wherein
the sealing sheet is a double-sided adhesive tape bonded to the water-resisting wall and the cover.

3. The water-resistant electronic component according to claim 1, wherein the body further has at least one second water-retaining hole extending outside and along the water-resisting wall.

4. The water-resistant electronic component according to claim 3, wherein the body further includes a pair of partitions extending one on each side of the second water-retaining hole from the water-resisting wall.

5. The water-resistant electronic component according to claim 3, wherein the cover includes:
a cover body of platelike shape covering the sealing sheet and the water-resisting wall; and
a lug extending from an end of the cover body to the other side in the first direction, the lug being received in the second water-retaining hole.

6. The water-resistant electronic component according to claim 5, wherein
the lug of the cover is engaged in the second water-retaining hole.

7. The water-resistant electronic component according to claim 5, further comprising a circuit board, wherein
the second water-retaining hole passes through the body in the first direction,
the circuit board is disposed such as to cover the second water-retaining hole at least partly from the other side in the first direction, and
the lug of the cover is grounded to the circuit board.

8. The water-resistant electronic component according to claim 1, wherein
the body further has at least one groove substantially surrounding the water-resisting wall.

9. The water-resistant electronic component according to claim 8, wherein the cover includes:
a cover body of platelike shape covering the sealing sheet and the water-resisting wall; and
a side plate extending from an end of the cover body to the other side in the first direction, the side plate being received in the groove.

10. The water-resistant electronic component according to claim 8, wherein
the sealing sheet is a double-sided adhesive tape bonded to the water-resisting wall and the cover.

11. The water-resistant electronic component according to claim 8, wherein the body further has a first water-retaining hole formed in a bottom of the groove.

12. The water-resistant electronic component according to claim 11, wherein the cover includes:
a cover body of platelike shape covering the sealing sheet and the water-resisting wall; and
a side plate extending from an end of the cover body to the other side in the first direction, the side plate being received in the groove and the first water-retaining hole.

13. The water-resistant electronic component according to claim 8, wherein
the groove has such a crosswise dimension as to allow the groove to collect liquid entering the groove by capillary action.

14. The water-resistant electronic component according to claim 13, wherein the body further has a first water-retaining hole formed in a bottom of the groove.

15. The water-resistant electronic component according to claim 13, wherein the cover includes:
a cover body of platelike shape covering the sealing sheet and the water-resisting wall; and
a side plate extending from an end of the cover body to the other side in the first direction, the side plate being received in the groove.

16. The water-resistant electronic component according to claim 13, wherein
the groove includes a first groove portion of generally rectilinear shape and a second groove portion of generally rectilinear shape,
the first groove portion includes a first end and a second end opposite to each other in a longitudinal direction of the first groove portion,
the second groove portion extends from the second end of the first groove portion in a direction crossing the first groove portion, the second groove portion includes first and second ends opposite to each other in a longitudinal direction of the second groove portion, and the first end of the second groove portion communicates with the second end of the first groove portion, and a relation D1<D2<D3 is satisfied, where D1 is a crosswise dimension of the first end of the first groove portion, D2 is a crosswise dimension of the first end of the second groove portion, and D3 is a crosswise dimension of the second end of the second groove portion.

17. The water-resistant electronic component according to claim 16, wherein the groove is generally U-shaped and further includes a third groove portion of generally rectilinear shape, the third groove portion extends from the second end of the second groove portion in a direction crossing the second groove portion, the third groove portion includes first and second ends opposite to each other in a longitudinal direction of the third groove portion, and the first end of the third groove portion communicates with the second end of the second groove portion, a relation D1<D2<D3<D4 is satisfied, where D4 is a crosswise dimension of the second end of the third groove portion.

18. The water-resistant electronic component according to claim 13, wherein the groove includes a first portion and a second portion spaced from each other in a longitudinal direction of the groove, and the crosswise dimension of the groove gradually decreases from the first portion to the second portion.

19. The water-resistant electronic component according to claim 18, wherein the body further has a first water-retaining hole formed in a bottom of the groove.

20. The water-resistant electronic component according to claim 18, wherein the cover includes:

a cover body of platelike shape covering the sealing sheet and the water-resisting wall; and a side plate extending from an end of the cover body to the other side in the first direction, the side plate being received in the groove.

* * * * *